US011205372B2

(12) United States Patent
Yang et al.

(10) Patent No.: US 11,205,372 B2
(45) Date of Patent: Dec. 21, 2021

(54) SOURCE DRIVING CIRCUIT, DRIVING METHOD AND DISPLAY DEVICE

(71) Applicants: Beijing BOE Display Technology Co., Ltd., Beijing (CN); BOE TECHNOLOGY GROUP CO., LTD., Beijing (CN)

(72) Inventors: Yan Yang, Beijing (CN); Chinghua Hung, Beijing (CN); Rui Liu, Beijing (CN); Wei Sun, Beijing (CN); Ming Chen, Beijing (CN); Qibing Gu, Beijing (CN); Xiangyi Chen, Beijing (CN)

(73) Assignees: Beijing BOE Display Technology Co., Ltd., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/960,574

(22) PCT Filed: Sep. 23, 2019

(86) PCT No.: PCT/CN2019/107364

§ 371 (c)(1),
(2) Date: Jul. 8, 2020

(87) PCT Pub. No.: WO2021/056158

PCT Pub. Date: Apr. 1, 2021

(65) Prior Publication Data

US 2021/0166610 A1 Jun. 3, 2021

(51) Int. Cl.
*G09G 3/20* (2006.01)

(52) U.S. Cl.
CPC ... *G09G 3/2092* (2013.01); *G09G 2310/0254* (2013.01); *G09G 2310/0291* (2013.01)

(58) Field of Classification Search
CPC ..... G09G 3/2092; G09G 2310/0291; G09G 2310/0254; G09G 3/3688; G09G 3/3677; G09G 2310/0264; G09G 2310/0297
See application file for complete search history.

(56) References Cited

U.S. PATENT DOCUMENTS 8,009,155 B2 * 8/2011 Chen ..... G09G 3/3688 345/204
8,310,422 B2 * 11/2012 Nishimura ..... H03F 3/45183 345/87

(Continued)

FOREIGN PATENT DOCUMENTS

CN 102436789 A 5/2012
CN 103985347 A 8/2014

(Continued)

OTHER PUBLICATIONS

Written Opinion for International Application No. PCT/CN2019/107364 dated May 22, 2020.

*Primary Examiner* — Michael J Jansen, II
(74) *Attorney, Agent, or Firm* — Thomas | Horstemeyer, LLP

(57) ABSTRACT

A source driving circuit includes a buffer amplifier configured to generate a driving signal from an original driving signal. The buffer amplifier includes a first amplifier and a second amplifier. A high-level terminal of the first amplifier is coupled to the first power signal terminal, a low-level terminal is coupled to the second power signal terminal, and an output terminal is configured to output a positive polarity driving signal. A high-level terminal of the second amplifier is coupled to the third power signal terminal, a low-level terminal is coupled to the fourth power signal terminal, and an output terminal is configured to output a negative polarity (Continued)

driving signal. The voltage of the second power signal terminal is less than the voltage of the third power signal terminal.

13 Claims, 5 Drawing Sheets

(56) References Cited

U.S. PATENT DOCUMENTS 8,736,372 B2 * 5/2014 Chen ..... G09G 3/3674 330/259
8,854,020 B2 * 10/2014 Peron ..... H02M 3/1588 323/272
8,970,575 B2 * 3/2015 Lee ..... G09G 3/3696 345/212
9,030,453 B2 * 5/2015 Cho ..... G09G 3/3688 345/209
9,070,342 B2 * 6/2015 Wu ..... G09G 3/3685
9,305,503 B2 * 4/2016 Wu ..... G09G 3/3685
9,373,298 B2 * 6/2016 Shin ..... G09G 3/3614
9,406,273 B2 * 8/2016 Kim ..... G09G 3/3688
9,558,698 B2 * 1/2017 Chen ..... G09G 3/3614
9,893,729 B2 * 2/2018 Kuo ..... H03K 19/018521
10,026,375 B2 * 7/2018 Wang ..... H03K 17/6872
10,176,767 B2 * 1/2019 Xu ..... H03M 1/66
10,467,973 B2 * 11/2019 Ko ..... G09G 3/3688
10,504,471 B2 * 12/2019 Kim ..... G09G 3/3614
10,720,121 B2 * 7/2020 Kim ..... G09G 3/3685
10,902,806 B2 * 1/2021 Choi ..... H03F 3/45219
10,984,740 B2 * 4/2021 Kim ..... G09G 3/3688
2006/0238452 A1 * 10/2006 Onozawa ..... G09G 3/2085 345/60
2008/0089003 A1 * 4/2008 Kojima ..... G09G 3/20 361/246
2009/0040165 A1 * 2/2009 Shimatani ..... H03F 3/45179 345/98
2009/0201237 A1 * 8/2009 Nishimura ..... H03F 3/4521 345/87
2009/0251174 A1 * 10/2009 Chen ..... G09G 3/3688 327/108
2009/0289930 A1 * 11/2009 Nishimura ..... H03F 3/45219 345/211
2010/0033463 A1 * 2/2010 Nishimura ..... H03F 3/3022 345/211
2011/0050665 A1 * 3/2011 Tsai ..... G09G 3/3688 345/211
2011/0140521 A1 * 6/2011 Peron ..... H02M 3/1588 307/31
2011/0175892 A1 * 7/2011 Lee ..... G09G 3/3696 345/212
2011/0234560 A1 * 9/2011 Shin ..... G09G 3/003 345/208
2011/0310080 A1 * 12/2011 Tonomura ..... G09G 3/3688 345/211
2012/0161661 A1 * 6/2012 Cho ..... G09G 3/3696 315/241 R
2012/0249244 A1 * 10/2012 Chen ..... H03F 3/45183 330/253
2013/0127806 A1 * 5/2013 Wu ..... G09G 3/3688 345/211
2015/0255027 A1 * 9/2015 Wu ..... G09G 3/3614 345/96
2015/0287374 A1 * 10/2015 Chen ..... G09G 3/3648 345/98
2015/0325200 A1 * 11/2015 Rho ..... G09G 3/3688 345/212
2016/0142056 A1 * 5/2016 Kuo ..... H03K 19/018521 345/213
2017/0032755 A1 * 2/2017 Ko ..... G09G 3/3648
2017/0249913 A1 * 8/2017 Kim ..... G09G 3/3614
2017/0287430 A1 * 10/2017 Wang ..... H03K 17/6872
2018/0174530 A1 * 6/2018 Xu ..... G09G 3/3696
2019/0080660 A1 * 3/2019 Kim ..... H03F 3/45224
2020/0035175 A1 * 1/2020 Choi ..... G09G 3/3685
2020/0043435 A1 * 2/2020 Kim ..... G09G 3/3685

FOREIGN PATENT DOCUMENTS

EP 2369575 A2 9/2011
EP 2369575 A3 6/2012
KR 20170014352 A 2/2017

* cited by examiner

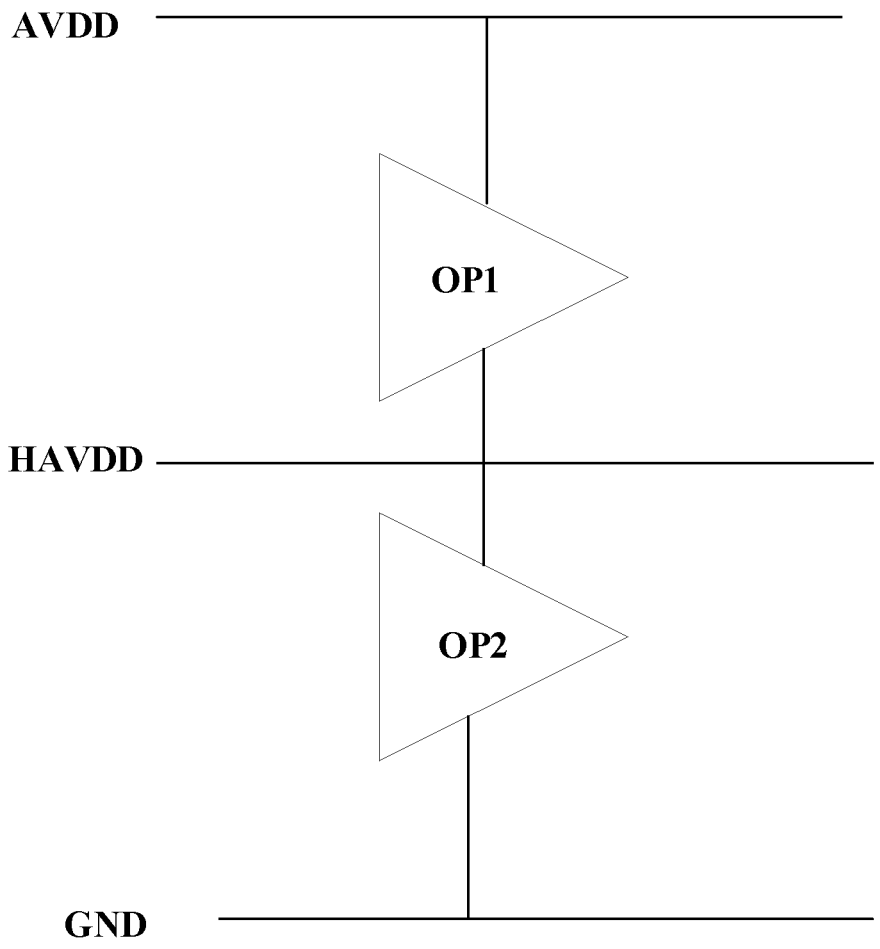
FIG. 1 *(Prior Art)*
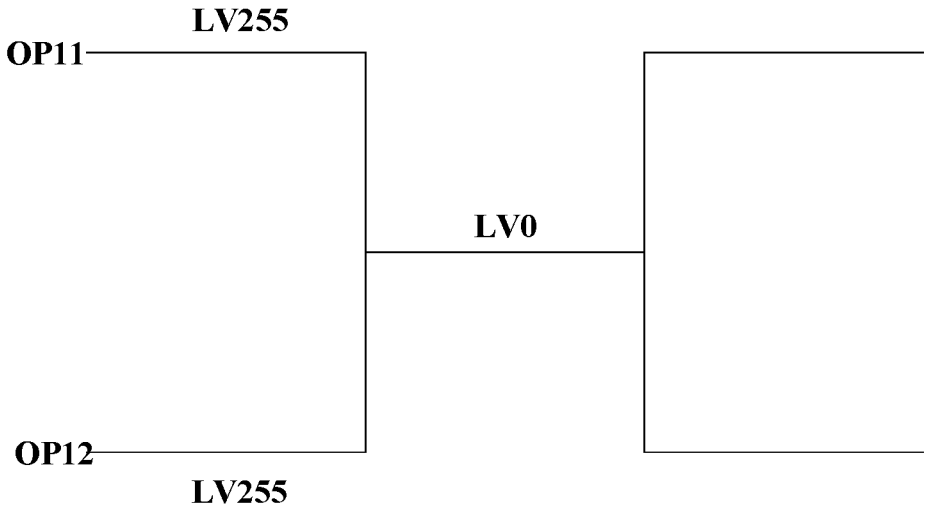
FIG. 2 *(Prior Art)*

SOURCE DRIVING CIRCUIT, DRIVING METHOD AND DISPLAY DEVICE

CROSS REFERENCE TO RELATED APPLICATION

This application is a national phase application under 35 U.S.C. § 371 of International Patent Application No. PCT/CN2019/107364 filed on Sep. 23, 2019, the contents of which are incorporated by reference in their entirety herein.

TECHNICAL FIELD

The present disclosure relates to the field of display technologies and, in particular, to a source driving circuit, a driving method, and a display device.

BACKGROUND

Display panels usually display pictures in a progressive scanning manner. During a display period of one frame, a control chip is required to progressively scan all pixel units in a display area.

As a frame rate of the display panel increases, a charging time for each row of sub-pixel units becomes shorter. Meeting a preset charging requirement for each pixel unit has become a key issue in a design of the display panel.

It should be noted that the information disclosed in the Background above is only for enhancing the understanding of the background of the present disclosure and thus, may include information that does not constitute prior art known to those of ordinary skill in the art.

SUMMARY

According to an aspect of the present disclosure, there is provided a source driving circuit including a buffer amplifier configured to generate a driving signal from an original driving signal. The buffer amplifier includes a first amplifier and a second amplifier. A high-level terminal of the first amplifier is coupled to a first power signal terminal, a low-level terminal of the first amplifier is coupled to a second power signal terminal, and an output terminal of the first amplifier is configured to output a positive polarity driving signal. A high-level terminal of the second amplifier is coupled to a third power signal terminal, a low-level terminal of the second amplifier is coupled to a fourth power signal terminal, and an output terminal of the second amplifier is configured to output a negative polarity driving signal. A voltage of the second power signal terminal is less than a voltage of the third power signal terminal.

In an exemplary embodiment of the present disclosure, a voltage of the first power signal terminal is a voltage of an analog power signal; a voltage of the fourth power signal terminal is a ground voltage; the voltage of the second power signal terminal is less than a voltage of a half-value analog power signal; and the voltage of the third power signal terminal is greater than the voltage of a half-value analog power signal.

In an exemplary embodiment of the present disclosure, the buffer amplifier further includes a switching assembly; the low-level terminal of the first amplifier is coupled to either the second power signal terminal or a fifth power signal terminal through the switching assembly; the high-level terminal of the second amplifier is coupled to either the third power signal terminal or the fifth power signal terminal through the switching assembly; the switching assembly is configured to couple the low-level terminal of the first amplifier to the second power signal terminal and couple the high-level terminal of the second amplifier to the third power signal terminal in a first driving state, and to couple the low-level terminal of the first amplifier to the fifth power signal terminal and couple the high-level terminal of the second amplifier to the fifth power signal terminal in a second driving state.

In an exemplary embodiment of the present disclosure, a voltage of the fifth power signal terminal is equal to the voltage of the half-value analog power signal.

In an exemplary embodiment of the present disclosure, the source driving circuit further includes a detection circuit, an arithmetic circuit, and a control circuit. The detection circuit is configured to detect a potential of an effective pulse signal for each row in the original driving signal in real time; the arithmetic circuit is coupled to the detection circuit and is configured to calculate a potential difference between the effective pulse signal for a current row and the effective pulse signal for a previous row in real time based on the potential of the effective pulse signal for each row; the control circuit is coupled to the arithmetic circuit and the switching assembly and is configured to send a control signal to the switching assembly based on the potential difference between the effective pulse signal for current row and the effective pulse signal for previous row to control a driving state of the switching assembly; wherein, when the potential difference between the effective pulse signal for the current row and the effective pulse signal for the previous row is greater than a preset value, the switching assembly is controlled to operate in the first driving state during at least a portion of a period of the current row; and when the potential difference between the effective pulse signal for the current row and the effective pulse signal for the previous row is less than the preset value, the switching assembly is controlled to operate in the second driving state during a drive period of the current row.

In an exemplary embodiment of the present disclosure, the switching assembly includes a first switching unit, a second switching unit, a third switching unit, and a fourth switching unit. The first switching unit is coupled to the low-level terminal of the first amplifier, the second power signal terminal, and a first control terminal, and is configured to connect the low-level terminal of the first amplifier with the second power signal terminal in response to a signal of the first control terminal; the second switching unit is coupled to the high-level terminal of the second amplifier, the third power signal terminal, and the first control terminal, and is configured to connect the high-level terminal of the second amplifier with the third power signal terminal in response to the signal of the first control terminal; the third switching unit is coupled to the low-level terminal of the first amplifier, the fifth power signal terminal, and a second control terminal, and is configured to connect the low-level terminal of the first amplifier with the fifth power signal terminal in response to a signal of the second control terminal; and the fourth switching unit is coupled to the high-level terminal of the second amplifier, the fifth power signal terminal, and the second control terminal, and is configured to connect the high-level terminal of the second amplifier with the fifth power signal terminal in response to the signal of the second control terminal.

In an exemplary embodiment of the present disclosure, the first switching unit includes a first switching transistor having a first terminal coupled to the low-level terminal of the first amplifier, a second terminal coupled to the second power signal terminal, and a control terminal coupled to the first control terminal;

the second switching unit includes a second switching transistor having a first terminal coupled to the high-level terminal of the second amplifier, a second terminal coupled to the third power signal terminal, and a control terminal coupled to the first control terminal;

the third switching unit includes a third switching transistor having a first terminal coupled to the low-level terminal of the first amplifier, a second terminal coupled to the fifth power signal terminal, and a control terminal coupled to the second control terminal; and the fourth switching unit includes a fourth switching transistor having a first terminal coupled to the high-level terminal of the second amplifier, a second terminal coupled to the fifth power signal terminal, and a control terminal coupled to the second control terminal.

In an exemplary embodiment of the present disclosure, the first switching transistor, the second switching transistor, the third switching transistor, and the fourth switching transistor are N-type transistors or P-type transistors.

According to another aspect of the present disclosure, there is provided a driving method of a source driving circuit, for driving the source driving circuit described above, and the method includes:

outputting the positive polarity driving signal by the first amplifier in a positive drive phase;

outputting the negative polarity driving signal by the second amplifier in a negative drive phase.

In an exemplary embodiment of the present disclosure, the source driving circuit further includes a switching assembly, and the method further includes:

by the switching assembly:

connecting the low-level terminal of the first amplifier with the second power signal terminal and connecting the high-level terminal of the second amplifier with the third power signal terminal in a first driving state; and connecting the low-level terminal of the first amplifier with a fifth power signal terminal and connecting the high-level terminal of the second amplifier with the fifth power signal terminal in a second driving state.

In an exemplary embodiment of the present disclosure, the source driving circuit further includes a detection circuit, an arithmetic circuit, and a control circuit, and the method further includes:

detecting by the detection circuit a potential of an effective pulse signal for each row in the original driving signal in real time;

calculating by the arithmetic circuit a potential difference between the effective pulse signal for a current row and the effective pulse signal for a previous row in real time based on the potential of the effective pulse signal for each row;

sending by the control circuit a control signal to the switching assembly based on the potential difference between the effective pulse signal for the current row and the effective pulse signal for the previous row to control a driving state of the switching assembly;

wherein, when the potential difference between the effective pulse signal for the current row and the effective pulse signal for the previous row is greater than a preset value, the switching assembly is controlled to operate in the first driving state during at least a portion of a period of the current row; and when the potential difference between the effective pulse signal for the current row and the effective pulse signal for the previous row is less than the preset value, the switching assembly is controlled to operate in the second driving state during a driving period of the current row.

According to another aspect of the present disclosure, there is provided a display device including the source driving circuit described above.

It should be noted that the above general description and the following detailed description are merely exemplary and explanatory and should not be construed as limiting the present disclosure.

BRIEF DESCRIPTION OF THE DRAWINGS

The accompanying drawings, which are incorporated into and constitute a part of the specification, show embodiments consistent with the present disclosure, and are used to explain the principles of the present disclosure together with the specification. It is understood that the drawings in the following description show only some of the embodiments of the present disclosure, and other drawings can be obtained by those skilled in the art based on these drawings without any creative effort.

FIG. 1 is a schematic structural diagram of a source driving circuit in the related art;

FIG. 2 is a timing diagram of an output signal of a source driving circuit in the related art;

DETAILED DESCRIPTION

Figure 3:
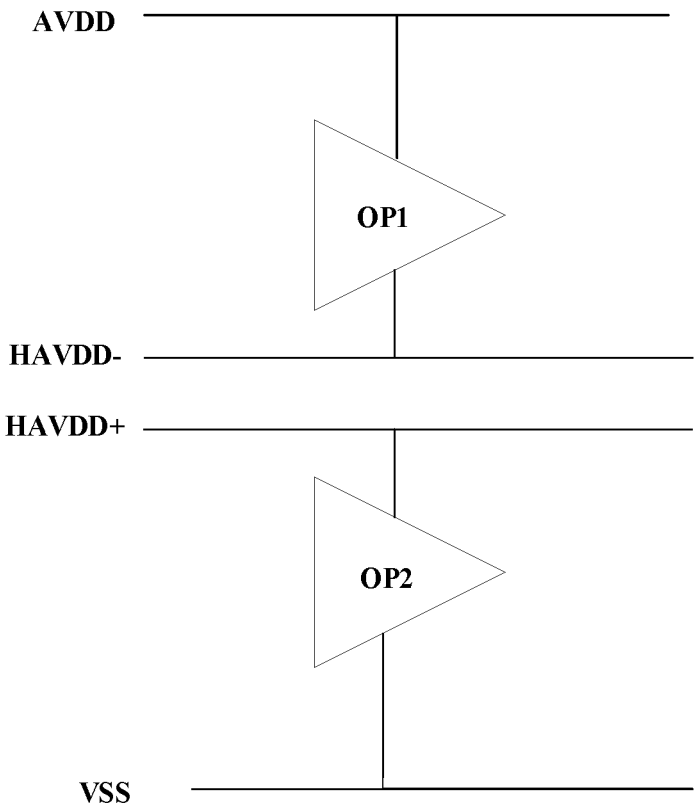
FIG. 3 is a schematic structural diagram of an exemplary embodiment of a source driving circuit of the present disclosure.

Exemplary embodiments will now be described more fully with reference to the drawings. However, the exemplary embodiments can be implemented in various forms, and should not be construed as being limited to the examples set forth herein; rather, these embodiments are provided to make the present disclosure more comprehensive and complete, and fully convey the ideas of the exemplary embodiments to those skilled in the art. The same reference numerals in the drawings indicate the same or similar structures, and thus the detailed description thereof will be omitted.

Although relative terms are used in this specification, such as "upper" and "lower", to describe the relative relationship between one component and another component shown in the drawings, these terms are used in this specification only for convenience, for example, in the direction shown in the examples of the drawings. It can be understood that if the device shown is turned upside down, the component described as "upper" will become the "lower" component. Other relative terms, such as "high", "low", "top", "bottom", "left", "right", etc., have similar meanings. When a structure is said to be "on" another structure, it may indicate that the structure is integrally formed on the other structure, or that the structure is "directly" provided on the other structure, or that the structure is provided on the other structure "indirectly" through another structure.

The terms "a", "an", "the", and "said" are used to indicate the presence of one or more elements/components, etc.; the terms "include/including" and "have/having" are used to represent an open-ended sense of inclusion and mean that there may be additional elements/components, etc., in addition to the listed elements/components, etc.

In the related art, as the frame rate of the display panel increases, a charging time for each row of sub-pixel units becomes increasingly shorter, and due to a voltage drop caused by a resistance and a parasitic capacitance of data lines, charging voltages for the sub-pixel units on a side away from the source driving circuit cannot meet the preset requirement, which finally causes a uneven display of the display panel.

In view of the above technical problems, and based on that a reference power supply for the source driving circuit is provided by an analog power signal AVDD, the voltage of the driving signal can be increased by increasing the voltage of the analog power signal AVDD in the related art to solve the above technical problems. However, after the analog power signal AVDD is increased, a potential difference between effective pulses for adjacent rows in the driving signal will be increased. For example, in an example where the first row displays at 255 gray-scale and the second row displays at 0 gray-scale, when the voltage of the analog power signal AVDD is 18V, the voltage of the effective pulse for the first row is 16V and the voltage of the effective pulse for the second row is 8V; and when the voltage of the analog power signal AVDD is 20V, the voltage of the effective pulse for the first row is 18V and the voltage of the effective pulse for the second row is 9V. Understandably, a former voltage difference (8V) of the effective pulses for adjacent rows is smaller than a latter voltage difference (9V) of the effective pulses for adjacent rows.

FIG. 1 is a schematic structural diagram of a source driving circuit in the related art. As shown in FIG. 1, in the related art, the source driving circuit can include a buffer amplifier configured to generate a driving signal from an original driving signal. In the related art, the buffer amplifier can include a first amplifier OP1 and a second amplifier OP2. A high-level terminal of the first amplifier OP1 receives the analog power signal AVDD, a low-level terminal of the first amplifier OP1 receives a half-value analog power signal HAVDD, and an output terminal of the first amplifier OP1 is configured to output a positive polarity driving signal; a high-level terminal of the second amplifier OP2 receives the half-value analog power signal HAVDD, a low-level terminal of the second amplifier OP2 is connected to a ground terminal GND, and an output terminal of the second amplifier OP2 is configured to output a negative polarity driving signal. The buffer amplifier is configured for increasing a load capacity of a signal, so as to convert the original driving signal with a lower load capacity into the driving signal with a higher load capacity. FIG. 2 is a timing diagram of an output signal of a source driving circuit in the related art, and as shown in FIG. 2, OP11 indicates the positive polarity driving signal output by the first amplifier OP1, OP12 indicates the negative polarity driving signal output by the second amplifier OP2, LV255 indicates a voltage of the driving signal at 255 gray-scale, and LV0 indicates a voltage of the driving signal at 0 gray-scale. A voltage range of the driving signal outputted by the first amplifier OP1 is in between the voltage of the half-value analog power signal HAVDD and the voltage of the analog power signal AVDD, and a voltage range of the driving signal outputted by the second amplifier OP2 is in between the voltage of the half-value analog power signal HAVDD and the voltage of the ground GND. Since the first amplifier OP1 and the second amplifier OP2 share the half-value analog power signal HAVDD, the voltage of the positive polarity driving signal and the voltage of the negative polarity driving signal are equal at 0 gray-scale.

Since it also takes time for the buffer amplifier to convert the signal, and the greater the voltage difference between the pulse signals for the adjacent rows in the original driving signal, the longer the time required for the buffer amplifier to convert the signal. Therefore, the increase in the voltage of the analog power signal AVDD will cause an increase in the time for the source driving circuit to output the driving signal. As a result, the data signal cannot reach the preset voltage within a time interval between the adjacent effective pulses.

In view of the above problems, an exemplary embodiment of the present disclosure provides a source driving circuit. FIG. 3 is a schematic structural diagram of an exemplary embodiment of a source driving circuit of the present disclosure, and as shown in FIG. 3, the source driving circuit includes a buffer amplifier configured to generate a driving signal from an original driving signal. The buffer amplifier includes a first amplifier OP1 and a second amplifier OP2. A high-level terminal of the first amplifier OP1 is coupled to a first power signal terminal AVDD, a low-level terminal of the first amplifier OP1 is coupled to a second power signal terminal HAVDD−, and an output terminal of the first amplifier OP1 is configured to output a positive polarity driving signal; a high-level terminal of the second amplifier OP2 is coupled to a third power signal terminal HAVDD+, a low-level terminal of the second amplifier OP2 is coupled to a fourth power signal terminal VSS, and an output terminal of the second amplifier OP2 is configured to output a negative polarity driving signal; and a voltage of the second power signal terminal HAVDD− is less than a voltage of the third power signal terminal HAVDD+.

A voltage of the first power signal terminal AVDD can be the voltage of the analog power signal AVDD, the voltage of the second power signal terminal HAVDD− can be less than a voltage of a half-value analog power signal HAVDD, the voltage of the third power signal terminal HAVDD+ can be greater than the voltage of the half-value analog power signal HAVDD, and a voltage of the fourth power signal terminal can be a voltage of the ground terminal. The voltage of the second power signal terminal HAVDD− is in between the voltage of the first power signal terminal AVDD and the voltage of the fourth power signal terminal VSS; the voltage of the third power signal terminal HAVDD+ is in between the voltage of the first power signal terminal AVDD and the voltage of the fourth power signal terminal VSS.

Figure 4:
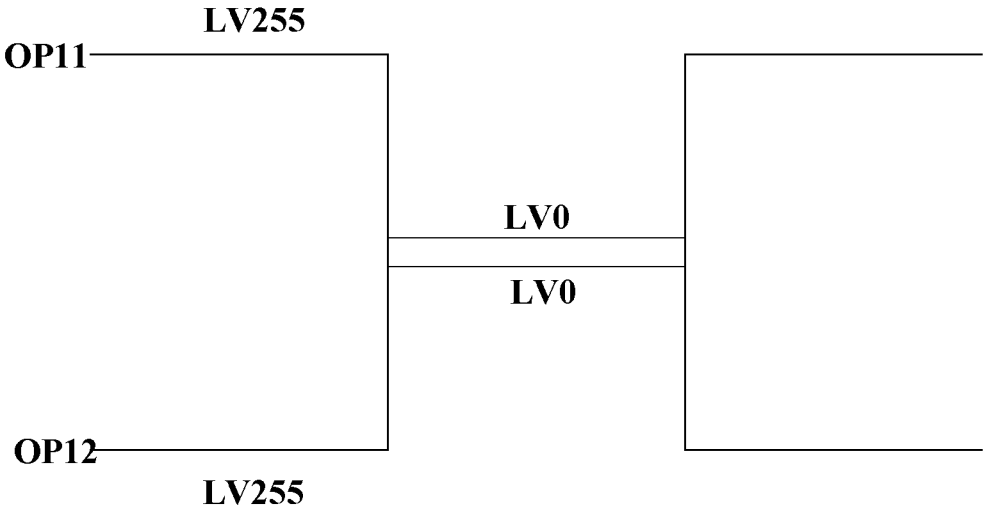
FIG. 4 is a timing diagram of an output signal in an exemplary embodiment of a source driving circuit of the present disclosure.

FIG. 4 is a timing diagram of an output signal in an exemplary embodiment of a source driving circuit of the present disclosure, and as shown in FIG. 4, OP11 indicates the positive polarity driving signal output by the first amplifier OP1, OP12 indicates the negative polarity driving signal output by the second amplifier OP2, LV255 indicates a voltage of the driving signal at 255 gray-scale, and LV0 indicates a voltage of the driving signal at 0 gray-scale. A voltage range of the driving signal outputted by the first amplifier OP1 is in between the voltage of the second power signal terminal HAVDD− and the voltage of the first power signal terminal AVDD, and a voltage range of the driving signal outputted by the second amplifier OP2 is in between the voltage of the third power signal terminal HAVDD+ and the voltage of the fourth power signal terminal VSS. Since the voltage of the second power signal terminal HAVDD− is less than the voltage of the third power signal terminal HAVDD+, a voltage of the driving signal outputted by the first amplifier OP1 is less than a voltage of the driving signal outputted by the second amplifier OP2 at 0 gray-scale.

Figure 5:
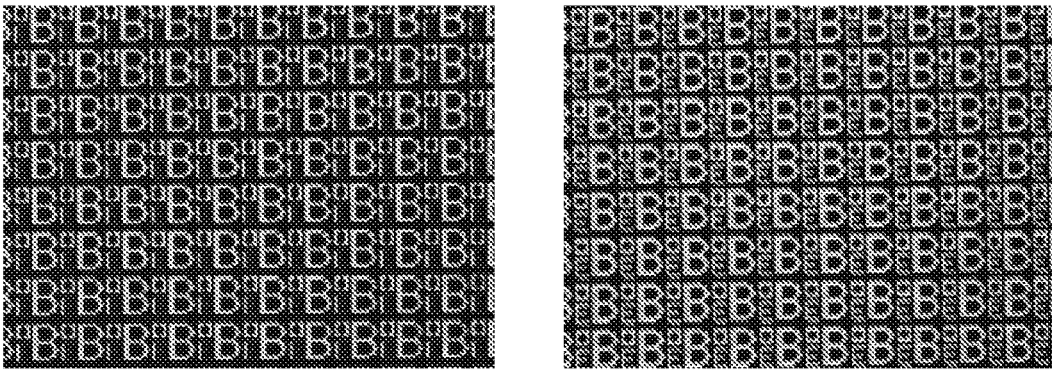
FIG. 5 is a comparison diagram of pictures generated by output signals of the source driving circuit in the related art and the source driving circuit in the present disclosure.

The present disclosure provides a source driving circuit. On one hand, the source driving circuit provided by the present disclosure can increase the voltage of the output driving signal by increasing the voltage of the analog power signal AVDD, thereby solving the technical problem of insufficient charging of the sub-pixel units; on the other hand, the source driving circuit provided by the present disclosure increases a changing rate of the output voltage of the amplifier and reduces the generation time of the driving signal by increasing the voltage difference between the high-level terminal and the low-level terminal of each of the first amplifier and the second amplifier, thereby solving the technical problem of excessive generation time of the driving signal caused by the increase of the analog power signal AVDD. In addition, in the positive polarity driving and the negative polarity driving, gamma voltages at 0 gray-scale correspond to the voltages of the second power signal terminal HAVDD− and the third power signal terminal HAVDD+, respectively, and by setting the level of the second power signal terminal to be lower than the level of the third power signal terminal, the voltage at 0 gray-scale in the positive polarity driving can be reduced and the voltage at 0 gray-scale in the negative polarity driving can be increased. That is, a target voltage drop is increased when the data signal transitions to 0 gray-scale, thereby increasing the rate of the data signal voltage drop and thus further reducing the time in which the data signal transitions to 0 gray-scale. FIG. 5 is a comparison diagram of pictures generated by the output signals of the source driving circuit in the related art and the source driving circuit in the present disclosure, and as shown in FIG. 5, the picture generated by the output signal of the source driving circuit in the related art is shown on the left, and the picture generated by the output signal of the source driving circuit in the present disclosure is shown in the right. The picture on the left side and the picture on the right side are pictures formed under the driving of the same image signal. Understandably, a black-and-white contrast of the left picture is smaller than that of the right picture. Specifically, a definition of characters "BOE" in the right picture is higher than that in the left picture.

Figure 6:
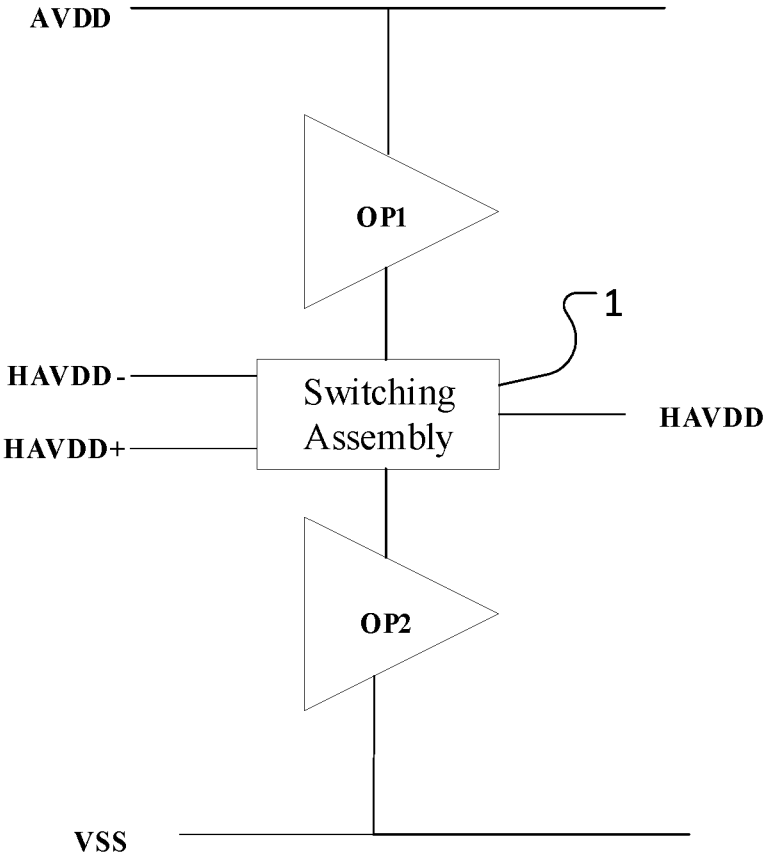
FIG. 6 is a schematic structural diagram of another exemplary embodiment of a source driving circuit of the present disclosure.

In this exemplary embodiment, the source driving circuit is provided with two power signal terminals: the second power signal terminal HAVDD− and the third power signal terminal HAVDD+. Although such arrangement can improve the display effect, it also increases power consumption of the source driving circuit. When the voltage difference between the effective pulses for the adjacent rows in the driving signal is small, the above-mentioned technical problem that "the data signal cannot reach the preset voltage within the time interval between the adjacent effective pulses" does not exist. FIG. 6 is a schematic structural diagram of another exemplary embodiment of a source driving circuit of the present disclosure, and as shown in FIG. 6, the buffer amplifier can further include a switching assembly 1; the low-level terminal of the first amplifier OP1 is coupled to either the second power signal terminal HAVDD− or a fifth power signal terminal HAVDD through the switching assembly 1; the high-level terminal of the second amplifier OP2 is coupled to either the third power signal terminal HAVDD+ or the fifth power signal terminal HAVDD through the switching assembly 1; the switching assembly is configured to connect the low-level terminal of the first amplifier OP1 to the second power signal terminal HAVDD− and connect the high-level terminal of the second amplifier OP2 to the third power signal terminal HAVDD+ in a first driving state, and to connect the low-level terminal of the first amplifier OP1 to the fifth power signal terminal HAVDD and connect the high-level terminal of the second amplifier OP2 to the fifth power signal terminal HAVDD in a second driving state. When the voltage difference between the effective pulses for the adjacent rows in the driving signal is large, the switching assembly operates in the first driving state, thereby solving the technical problem that the data signal cannot reach the preset voltage within the time interval between the adjacent effective pulses, and when the voltage difference between the effective pulses for the adjacent rows in the driving signal is small, the switching assembly operates in the second driving state, thereby solving the technical problem of large power consumption of the source driving circuit.

Figure 7:
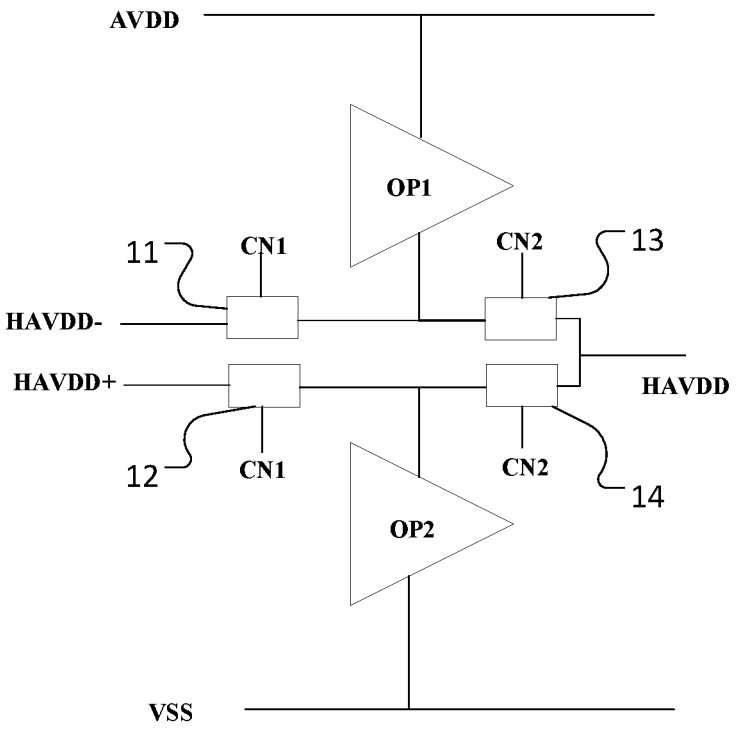
FIG. 7 is a schematic structural diagram of another exemplary embodiment of a source driving circuit of the present disclosure.

In this exemplary embodiment, FIG. 7 shows a schematic structural diagram of another exemplary embodiment of a source driving circuit of the present disclosure where the switching assembly can include a first switching unit 11, a second switching unit 12, a third switching unit 13, and a fourth switching unit 14. The first switching unit 11 is coupled to the low-level terminal of the first amplifier OP1, the second power signal terminal HAVDD−, and a first control terminal CN1, and is configured to connect the low-level terminal of the first amplifier OP1 with the second power signal terminal HAVDD− in response to a signal of the first control terminal CN; the second switching unit 12 is coupled to the high-level terminal of the second amplifier OP2, the third power signal terminal HAVDD+, and the first control terminal CN1, and is configured to connect the high-level terminal of the second amplifier OP2 with the third power signal terminal HAVDD+ in response to the signal of the first control terminal CN1; the third switching unit 13 is coupled to the low-level terminal of the first amplifier OP1, the fifth power signal terminal HAVDD and a second control terminal CN2, and is configured to connect the low-level terminal of the first amplifier OP1 with the fifth power signal terminal HAVDD in response to a signal of the second control terminal CN2; and the fourth switching unit 14 is coupled to the high-level terminal of the second amplifier OP2, the fifth power signal terminal HAVDD, and the second control terminal CN2, and is configured to connect the high-level terminal of the second amplifier OP2 with the fifth power signal terminal HAVDD in response to the signal of the second control terminal CN2.

Figure 8:
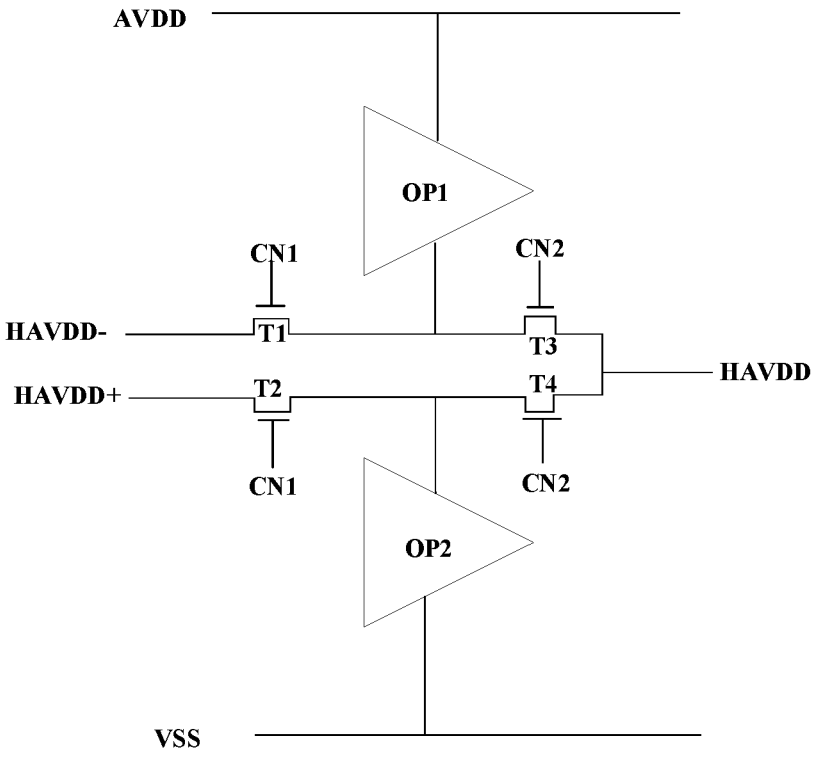
FIG. 8 is a schematic structural diagram of another exemplary embodiment of a source driving circuit of the present disclosure.

FIG. 8 is a schematic structural diagram of another exemplary embodiment of a source driving circuit of the present disclosure, and as shown in FIG. 8, in the exemplary embodiment of the present disclosure, the first switching unit 11 can include a first switching transistor T1, a first terminal of the first switching transistor is coupled to the low-level terminal of the first amplifier OP1, a second terminal of the first switching transistor is coupled to the second power signal terminal HAVDD−, and a control terminal of the first switching transistor is coupled to the first control terminal CN1. The second switching unit 12 can include a second switching transistor T2, a first terminal of the second switching transistor is coupled to the high-level terminal of the second amplifier OP2, a second terminal of the second switching transistor is coupled to the third power signal terminal HAVDD+, and a control terminal of the second switching transistor is coupled to the first Control terminal CN1; the third switching unit 13 can include a third switching transistor T3, a first terminal of the third switching transistor is coupled to the low-level terminal of the first amplifier OP1, and a second terminal of the third switching transistor is coupled to the fifth power signal terminal HAVDD, a control terminal of the third switching transistor is coupled to the second control terminal CN2; the fourth switching unit 14 can include a fourth switching transistor T4, a first terminal of the fourth switching transistor is coupled to the high-level terminal of the second amplifier OP2, a second terminal of the fourth switching transistor is coupled to the fifth power signal terminal, and a control terminal of the fourth switching transistor is coupled to the second control terminal CN2. The first switching transistor, the second switching transistor, the third switching transistor, and the fourth switching transistor are N-type transistors or P-type transistors.

Figure 9:
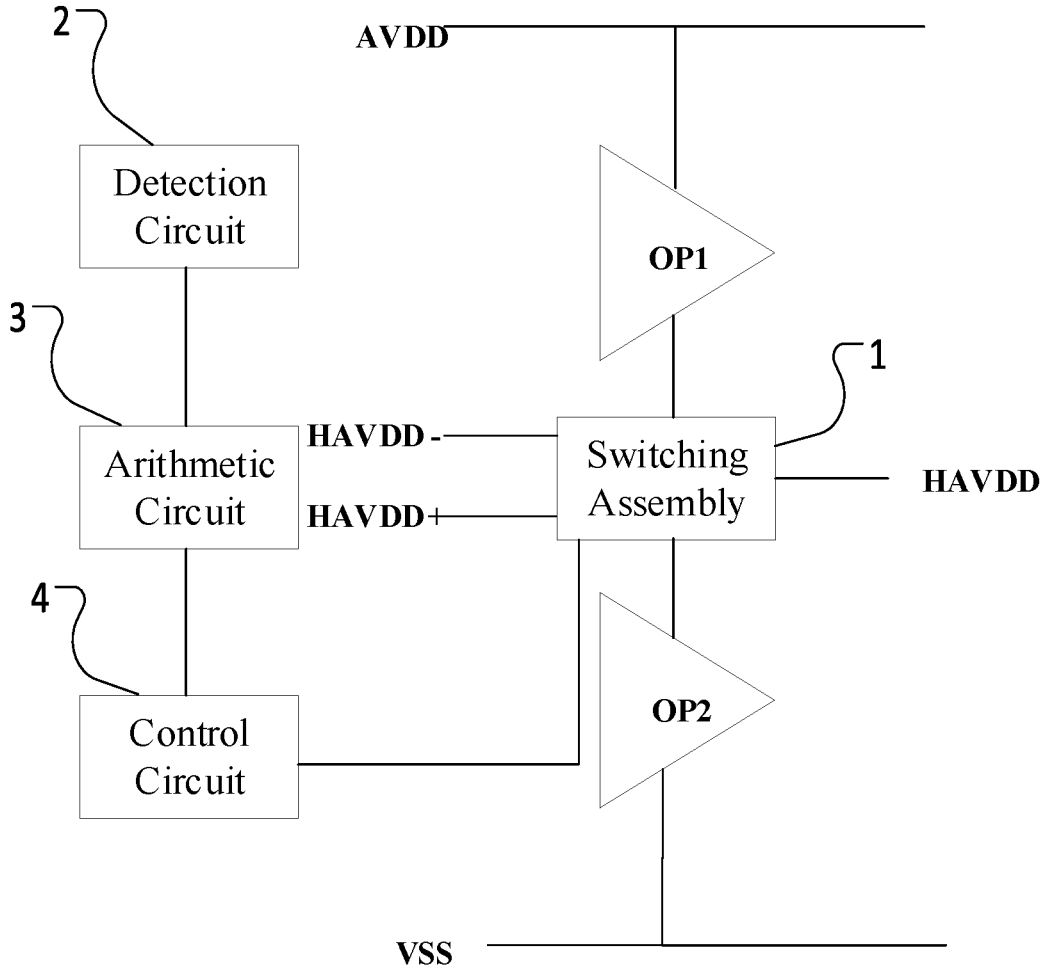
FIG. 9 is a schematic structural diagram of another exemplary embodiment of a source driving circuit of the present disclosure.

In an exemplary embodiment, as shown in FIG. 9 which is a schematic structural diagram of another exemplary embodiment of a source driving circuit of the present disclosure, the source driving circuit further includes a detection circuit 2, an arithmetic circuit 3, and a control circuit 4. The detection circuit 2 is configured to detect a potential of an effective pulse signal for each row in the original driving signal in real time; the arithmetic circuit 3 is coupled to the detection circuit 2 and is configured to calculate a potential difference between the effective pulse signal for a current row and the effective pulse signal for a previous row in real time based on the potential of the effective pulse signal for each row; and the control circuit 4 is coupled to the arithmetic circuit and the switching assembly, and is configured to send a control signal to the switching assembly based on the potential difference between the effective pulse signal for the current row and the effective pulse signal for the previous row to control the driving state of the switching assembly. When the potential difference between the effective pulse signal for the current row and the effective pulse signal for the previous row is greater than a preset value, the switching assembly is controlled to operate in the first driving state during at least a portion of a period of the current row, and when the potential difference between the effective pulse signal for the current row and the effective pulse signal for the previous row is less than the preset value, the switching assembly is controlled to operate in the second driving state during a drive period of the current row. With such arrangement, the driving state of the switching assembly can be controlled in real time, thereby solving the technical problem that the data signal cannot reach the preset voltage within the time interval between the adjacent effective pulses and solving the technical problem of large power consumption of the source driving circuit at the same time. When the potential difference between the effective pulse signal for the current row and the effective pulse signal for the previous row is greater than the preset value, the switching assembly can be controlled to operate in the first driving state during a portion of the period of the effective pulse for the current row, or to operate in the first driving state during the entire period of the effective pulse for the current row.

Figure 10:
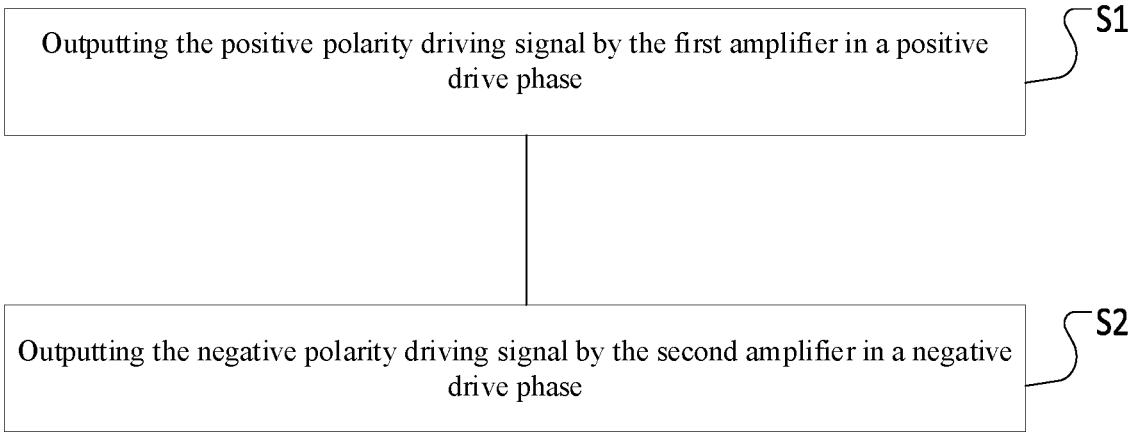
FIG. 10 is a flowchart of an exemplary embodiment of a driving method for a source driving circuit of the present disclosure.

The present exemplary embodiment also provides a driving method for a source driving circuit, which is used for driving the source driving circuit described above. FIG. 10 is a flowchart of an exemplary embodiment of a driving method for a source driving circuit of the present disclosure, and as shown in FIG. 10, the method includes:

in step S1, outputting the positive polarity driving signal by the first amplifier in a positive driving phase; and in step S2, outputting the negative polarity driving signal by the second amplifier in a negative driving phase.

In this exemplary embodiment, the source driving circuit further includes a switching assembly, and the method further includes:

by the switching assembly:

connecting the low-level terminal of the first amplifier with the second power signal terminal and connecting the high-level terminal of the second amplifier with the third power signal terminal in the first driving state; and connecting the low-level terminal of the first amplifier with the fifth power signal terminal and connecting the high-level terminal of the second amplifier with the fifth power signal terminal in the second driving state.

In this exemplary embodiment, the source driving circuit further includes a detection circuit, an arithmetic circuit, and a control circuit, and the method further includes:

detecting by the detection circuit a potential of effective pulse signal for each row in the original driving signal in real time;

calculating by the arithmetic circuit a potential difference between the effective pulse signal for a current row and the effective pulse signal for a previous row in real time based on the potential of the effective pulse signal for each row; and sending by the control circuit a control signal to the switching assembly based on the potential difference between the effective pulse signal for the current row and the effective pulse signal for the previous row to control the driving state of the switching assembly, wherein when the potential difference between the effective pulse signal for the current row and the effective pulse signal for the previous row is greater than a preset value, the switching assembly is controlled to operate in the first driving state during at least a portion of a period of the current row, and when the potential difference between the effective pulse signal for the current row and the effective pulse signal for the previous row is less than the preset value, the switching assembly is controlled to operate in the second driving state during a driving period of the current row.

The driving method for the source driving circuit provided by the present disclosure has the same technical features and operating principles as those for the source driving circuit described above, which have been described in detail and will not be repeated here.

The exemplary embodiment of the present disclosure also provides a display device including the source driving circuit described above.

The display device provided by the present disclosure has the same technical features and operating principles as those for the source driving circuit described above, which have been described in detail and will not be repeated here.

The display device can include, but is not limited to, a display device such as a TV, a mobile phone, a VR display device, and a laptop.

The present disclosure provides a source driving circuit, a driving method, and a display device. The source driving circuit includes a buffer amplifier configured to generate a driving signal from an original driving signal. The buffer amplifier includes a first amplifier and a second amplifier. A high-level terminal of the first amplifier is coupled to a first power signal terminal, a low-level terminal of the first amplifier is coupled to a second power signal terminal, and an output terminal of the first amplifier is configured to output a positive polarity driving signal; a high-level terminal of the second amplifier is coupled to a third power signal terminal, a low-level terminal of the second amplifier is coupled to a fourth power signal terminal, and an output terminal of the second amplifier is configured to output a negative polarity driving signal. A voltage of the second power signal terminal is less than a voltage of the third power signal terminal. On one hand, the source driving circuit provided by the present disclosure can increase the voltage of the output driving signal by increasing the voltage of the analog power signal AVDD, thereby solving the technical problem of insufficient charging of the sub-pixel units. On the other hand, the source driving circuit provided by the present disclosure increases a changing rate of the output voltage of the amplifier and reduces the generation time of the driving signal by increasing the voltage difference between the high-level terminals and the low-level terminals of the first amplifier and the second amplifier, thereby solving the technical problem of excessive generation time of the driving signal due to the increase of the analog power signal AVDD. In addition, by setting the level of the second power signal terminal to be lower than the level of the third power signal terminal, a positive driving voltage at 0 gray-scale can be reduced and a negative driving voltage at 0 gray-scale can be increased. That is, a target voltage drop is increased when the data signal transitions to the 0 gray-scale, thereby increasing the rate of the data signal voltage drop and thus further reducing time in which the data signal transitions to the 0 gray-scale.

Other embodiments of the present disclosure will be apparent to those skilled in the art after considering the specification and practicing the technical solutions disclosed herein. The present application is intended to cover any variations, uses, or adaptations of the present disclosure which follow the general principles of the present disclosure and include common knowledge or conventional technical measures in the art that are not disclosed in the present disclosure. The specification and embodiments are merely illustrative, and the real scope and spirit of the present disclosure is defined by the appended claims.

It should be understood that the present disclosure is not limited to the precise structures that have been described above and shown in the drawings, and various modifications and changes can be made without departing from the scope thereof. The scope of the present disclosure is limited only by the appended claims.

What is claimed is:

1. A source driving circuit, comprising a buffer amplifier configured to generate a driving signal from an original driving signal, wherein the buffer amplifier comprises:

a switching assembly;

a first amplifier having a high-level terminal coupled to a first power signal terminal, a low-level terminal coupled to a second power signal terminal or a fifth power signal terminal through the switching assembly, and an output terminal configured to output a positive polarity driving signal; and a second amplifier having a high-level terminal coupled to a third power signal terminal or the fifth power signal terminal through the switching assembly, a low-level terminal coupled to a fourth power signal terminal, and an output terminal configured to output a negative polarity driving signal, wherein a voltage of the second power signal terminal is less than a voltage of the third power signal terminal, and the switching assembly is configured to:

connect the low-level terminal of the first amplifier with the second power signal terminal and connect the high-level terminal of the second amplifier with the third power signal terminal in a first driving state; and connect the low-level terminal of the first amplifier with the fifth power signal terminal and connect the high-level terminal of the second amplifier with the fifth power signal terminal in a second driving state, wherein the source driving circuit further comprises:

a detection circuit configured to detect a potential of an effective pulse signal for each row in the original driving signal in real time;

an arithmetic circuit coupled to the detection circuit, and configured to calculate a potential difference between the effective pulse signal for a current row and the effective pulse signal for a previous row in real time based on the potential of the effective pulse signal for each row; and a control circuit coupled to the arithmetic circuit and the switching assembly, and configured to send a control signal to the switching assembly based on the potential difference between the effective pulse signal for the current row and the effective pulse signal for the previous row to control a driving state of the switching assembly, wherein:

when the potential difference between the effective pulse signal for the current row and the effective pulse signal for the previous row is greater than a preset value, the switching assembly is controlled to operate in the first driving state during at least a portion of a period of the current row; and when the potential difference between the effective pulse signal for the current row and the effective pulse signal for the previous row is less than or equal to the preset value, the switching assembly is controlled to operate in the second driving state during a driving period of the current row.

2. The source driving circuit according to claim 1, wherein:

a voltage of the first power signal terminal is a voltage of an analog power signal;

a voltage of the fourth power signal terminal is a ground voltage;

the voltage of the second power signal terminal is less than a voltage of a half-value analog power signal; and the voltage of the third power signal terminal is greater than the voltage of the half-value analog power signal.

3. The source driving circuit according to claim 1, wherein a voltage of the fifth power signal terminal is equal to the voltage of a half-value analog power signal.

4. The source driving circuit according to claim 1, wherein the switching assembly comprises:

a first switching unit coupled to the low-level terminal of the first amplifier, the second power signal terminal, and a first control terminal, and configured to connect the low-level terminal of the first amplifier with the second power signal terminal in response to a signal of the first control terminal;

a second switching unit coupled to the high-level terminal of the second amplifier, the third power signal terminal, and the first control terminal, and configured to connect the high-level terminal of the second amplifier with the third power signal terminal in response to the signal of the first control terminal;

a third switching unit coupled to the low-level terminal of the first amplifier, the fifth power signal terminal, and a second control terminal, and configured to connect the low-level terminal of the first amplifier with the fifth power signal terminal in response to a signal of the second control terminal; and a fourth switching unit coupled to the high-level terminal of the second amplifier, the fifth power signal terminal, and the second control terminal, and configured to connect the high-level terminal of the second amplifier with the fifth power signal terminal in response to the signal of the second control terminal.

5. The source driving circuit according to claim 4, wherein:

the first switching unit comprises a first switching transistor having a first terminal coupled to the low-level terminal of the first amplifier, a second terminal coupled to the second power signal terminal, and a control terminal coupled to the first control terminal;

the second switching unit comprises a second switching transistor having a first terminal coupled to the high-level terminal of the second amplifier, a second terminal coupled to the third power signal terminal, and a control terminal coupled to the first control terminal;

the third switching unit comprises a third switching transistor having a first terminal coupled to the low-level terminal of the first amplifier, a second terminal coupled to the fifth power signal terminal, and a control terminal coupled to the second control terminal; and the fourth switching unit comprises a fourth switching transistor having a first terminal coupled to the high-level terminal of the second amplifier, a second terminal coupled to the fifth power signal terminal, and a control terminal coupled to the second control terminal.

6. The source driving circuit according to claim 5, wherein the first switching transistor, the second switching transistor, the third switching transistor, and the fourth switching transistor are N-type transistors or P-type transistors.

7. A driving method for a source driving circuit, comprising:

providing the source driving circuit, wherein the source driving circuit comprises:

a buffer amplifier configured to generate a driving signal from an original driving signal, wherein the buffer amplifier comprises a switching assembly;

a first amplifier having a high-level terminal coupled to a first power signal terminal, a low-level terminal coupled to a second power signal terminal or a fifth power signal terminal through the switching assembly, and an output terminal configured to output a positive polarity driving signal;

a second amplifier having a high-level terminal coupled to a third power signal terminal or the fifth power signal terminal through the switching assembly, a low-level terminal coupled to a fourth power signal terminal, and an output terminal configured to output a negative polarity driving signal, wherein a voltage of the second power signal terminal is less than a voltage of the third power signal terminal, and wherein the switching assembly is configured to: connect the low-level terminal of the first amplifier with the second power signal terminal and connect the high-level terminal of the second amplifier with the third power signal terminal in a first driving state; and connect the low-level terminal of the first amplifier with the fifth power signal terminal and connect the high-level terminal of the second amplifier with the fifth power signal terminal in a second driving state; and a detection circuit, an arithmetic circuit, and a control circuit;

outputting the positive polarity driving signal by the first amplifier in a positive driving phase; and outputting the negative polarity driving signal by the second amplifier in a negative driving phase;

detecting, by the detection circuit, a potential of effective pulse signal for each row in the original driving signal in real time;

calculating, by the arithmetic circuit, a potential difference between the effective pulse signal for a current row and the effective pulse signal for a previous row in real time based on the potential of the effective pulse signal for each row; and sending, by the control circuit, a control signal to the switching assembly based on the potential difference between the effective pulse signal for the current row and the effective pulse signal for the previous row to control a driving state of the switching assembly, wherein:

when the potential difference between the effective pulse signal for the current row and the effective pulse signal for the previous row is greater than a preset value, the switching assembly is controlled to operate in the first driving state during at least a portion of a period of the current row, and when the potential difference between the effective pulse signal for the current row and the effective pulse signal for the previous row is less than the preset value, the switching assembly is controlled to operate in the second driving state during a driving period of the current row.

8. A display device, comprising a source driving circuit, the source driving circuit comprising a buffer amplifier configured to generate a driving signal from an original driving signal, wherein the buffer amplifier comprises:

a switching assembly;

a first amplifier having a high-level terminal coupled to a first power signal terminal, a low-level terminal coupled to a second power signal terminal or a fifth power signal terminal through the switching assembly, and an output terminal configured to output a positive polarity driving signal; and a second amplifier having a high-level terminal coupled to a third power signal terminal or the fifth power signal terminal through the switching assembly, a low-level terminal coupled to a fourth power signal terminal, and an output terminal configured to output a negative polarity driving signal, wherein a voltage of the second power signal terminal is less than a voltage of the third power signal terminal, and wherein the switching assembly is configured to:

connect the low-level terminal of the first amplifier with the second power signal terminal and connect the high-level terminal of the second amplifier with the third power signal terminal in a first driving state; and connect the low-level terminal of the first amplifier with the fifth power signal terminal and connect the high-level terminal of the second amplifier with the fifth power signal terminal in a second driving state, wherein the source driving circuit further comprises:

a detection circuit configured to detect a potential of an effective pulse signal for each row in the original driving signal in real time;

an arithmetic circuit coupled to the detection circuit, and configured to calculate a potential difference between the effective pulse signal for a current row and the effective pulse signal for a previous row in real time based on the potential of the effective pulse signal for each row; and a control circuit coupled to the arithmetic circuit and the switching assembly, and configured to send a control signal to the switching assembly based on the potential difference between the effective pulse signal for the current row and the effective pulse signal for the previous row to control a driving state of the switching assembly, wherein:

when the potential difference between the effective pulse signal for the current row and the effective pulse signal for the previous row is greater than a preset value, the switching assembly is controlled to operate in the first driving state during at least a portion of a period of the current row; and when the potential difference between the effective pulse signal for the current row and the effective pulse signal for the previous row is less than or equal to the preset value, the switching assembly is controlled to operate in the second driving state during a driving period of the current row.

9. The display device according to claim 8, wherein:

a voltage of the first power signal terminal is a voltage of an analog power signal;

a voltage of the fourth power signal terminal is a ground voltage;

the voltage of the second power signal terminal is less than a voltage of a half-value analog power signal; and the voltage of the third power signal terminal is greater than the voltage of the half-value analog power signal.

10. The display device according to claim 8, wherein a voltage of the fifth power signal terminal is equal to the voltage of a half-value analog power signal.

11. The display device according to claim 8, wherein the switching assembly comprises:

a first switching unit coupled to the low-level terminal of the first amplifier, the second power signal terminal, and a first control terminal, and configured to connect the low-level terminal of the first amplifier with the second power signal terminal in response to a signal of the first control terminal;

a second switching unit coupled to the high-level terminal of the second amplifier, the third power signal terminal, and the first control terminal, and configured to connect the high-level terminal of the second amplifier with the third power signal terminal in response to the signal of the first control terminal;

a third switching unit coupled to the low-level terminal of the first amplifier, the fifth power signal terminal, and a second control terminal, and configured to connect the low-level terminal of the first amplifier with the fifth power signal terminal in response to a signal of the second control terminal; and a fourth switching unit coupled to the high-level terminal of the second amplifier, the fifth power signal terminal, and the second control terminal, and configured to connect the high-level terminal of the second amplifier with the fifth power signal terminal in response to the signal of the second control terminal.

12. The display device according to claim 11, wherein:

the first switching unit comprises a first switching transistor having a first terminal coupled to the low-level terminal of the first amplifier, a second terminal coupled to the second power signal terminal, and a control terminal coupled to the first control terminal;

the second switching unit comprises a second switching transistor having a first terminal coupled to the high-level terminal of the second amplifier, a second terminal coupled to the third power signal terminal, and a control terminal coupled to the first control terminal;

the third switching unit comprises a third switching transistor having a first terminal coupled to the low-level terminal of the first amplifier, a second terminal coupled to the fifth power signal terminal, and a control terminal coupled to the second control terminal; and the fourth switching unit comprises a fourth switching transistor having a first terminal coupled to the high-level terminal of the second amplifier, a second terminal coupled to the fifth power signal terminal, and a control terminal coupled to the second control terminal.

13. The display device according to claim 12, wherein the first switching transistor, the second switching transistor, the third switching transistor, and the fourth switching transistor are N-type transistors or P-type transistors.

* * * * *